US006533638B1

(12) United States Patent
Nelson et al.

(10) Patent No.: US 6,533,638 B1
(45) Date of Patent: Mar. 18, 2003

(54) SYSTEM AND METHOD FOR ENGAGING A FINGER BOARD

(76) Inventors: Webb Nelson, 19180 144th Ave., NE., Woodinville, WA (US) 98072; Chan Yuk Ng, Suite 1306, Swire & Maclaine House, 19-23 Austin Ave, Kowloon Hong Kong (HK)

( * ) Notice: Subject to any disclaimer, the term of this patent is extended or adjusted under 35 U.S.C. 154(b) by 0 days.

(21) Appl. No.: 09/656,391

(22) Filed: Sep. 6, 2000

(51) Int. Cl.[7] ..... A63H 17/25

(52) U.S. Cl. ..... 446/279; 446/139; 446/465; 294/65.5

(58) Field of Search ..... 224/183; 269/8; 280/87.041, 87.042; 294/65.5; 446/129, 139, 279, 465

(56) References Cited

U.S. PATENT DOCUMENTS 1,412,381 A * 4/1922 Williams ..... 446/465 X
1,685,707 A * 9/1928 Keedy
2,471,764 A * 5/1949 Miller et al.
2,828,762 A * 4/1958 Swank
2,976,075 A * 3/1961 Budreck
3,082,002 A * 3/1963 Goldfarb ..... 446/465 X
3,771,084 A * 11/1973 Thon
5,024,611 A * 6/1991 Eckerle et al. ..... 446/139 X
6,074,271 A * 6/2000 Derrah ..... 446/457

FOREIGN PATENT DOCUMENTS

GB 2186501 * 8/1987 ..... 446/279

* cited by examiner

*Primary Examiner*—John A. Ricci
(74) *Attorney, Agent, or Firm*—LaMorte & Associates

(57) ABSTRACT

An amusement system that includes a miniature toy skateboard and the mechanism for engaging and lifting the miniature toy skateboard. The miniature toy skateboard is less than six inches long and is referred to as a finger board in the toy industry. The finger board is manufactured to have a top surface that is either magnetic or attracted to a magnet. The mechanism for engaging and lifting the finger board is a magnet that is held within an external object, such as a ring or a toy figure. A manually adjustable spacer is positioned in front of the magnet. To engage the finger board with the external object, the length of the spacer is minimized and the finger board is brought into close proximity with the magnet. The magnetic field created by the magnet attracts the finger board and holds the finger board against the external object. To detach the finger board, the length of the spacer is increased. This moves the external object out beyond the effective range of the magnetic field of the magnet. The pull from the magnet is then insufficient to hold the finger board in place and the finger board falls free.

12 Claims, 3 Drawing Sheets

SYSTEM AND METHOD FOR ENGAGING A FINGER BOARD

RELATED APPLICATIONS

This application is related to U.S. patent application Ser. No. 09,659,008 entitled Improved Finger Board Assembly And Amusement System which was filed concurrently with this application.

BACKGROUND OF THE INVENTION

1. Field of the Invention

The present invention relates to miniature toy skateboards, often referred to as finger boards and the toy figures that are used in conjunction with the finger boards. More particularly, the present invention relates to the structure of finger boards and the attachment mechanisms used to engage and manipulate finger boards.

2. Prior Art Statement

Skateboarding has become a popular and diversified sport. One specialized area of skateboarding is extreme skateboarding. Extreme skateboarding is when a person on a skateboard uses the skateboard to perform acrobatic jumps and other dangerous stunts. Extreme skateboarding is highly visibly entertaining. As such, extreme skateboarding is a very popular spectator sport among children.

Recognizing that many children like the sport of extreme skateboarding but are physically incapable of participating in extreme skateboarding events, amusement devices have been developed that mimic the sport. For example, many video games now have programs that enable players to participate in virtual extreme skateboarding events. In the area of toys, miniature skateboards are being manufactured that are only a few inches long. The miniature skateboard attaches to a child's fingers, wherein a child can mimic real skateboard stunts with his/her fingers. Since the miniature skateboards attach to a child's fingers, such miniature skateboards are referred to as finger boards in the toy industry.

Finger boards typically attach to a child's fingers using small looped structures on the finger board through which the fingertips pass. These small looped structures are also used to attach the feet of small toy figures to the finger boards. When a child is playing with a finger board, the manner in which the child can manipulate the finger board is limited by the confines of that child's fingers in the looped structures of the finger board. Due to this physical constraint, many stunts with finger boards are not possible and other stunts can only be done after a great deal of practice.

A need therefore exists for an improved finger board system that enables both a person's fingers and toy figures to be more easily manipulated once attached to a finger board. This need is met by the present invention as described and claimed below.

SUMMARY OF THE INVENTION

The present invention is an amusement system comprising a miniature toy skateboard and the mechanism for engaging and lifting the miniature toy skateboard. The miniature toy skateboard is less than six inches long and is referred to as a finger board in the toy industry. The finger board is manufactured to have a top surface that is either magnetic or attracted to a magnet. The mechanism for engaging and lifting the finger board is a magnet that is held within an external object, such as a ring or a toy figure. A manually adjustable spacer is positioned in front of the magnet. To engage the finger board with the external object, the length of the spacer is minimized and the finger board is brought into close proximity with the magnet. The magnetic field created by the magnet attracts the finger board and holds the finger board against the external object. To detach the finger board, the length of the spacer is increased. This moves the external object out beyond the effective range of the magnetic field of the magnet. The pull from the magnet is then insufficient to hold the finger board in place and the finger board falls free. Thus by manipulating the length of the adjustable spacer, a system is created where a finger board can be quickly and easily engaged and released.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
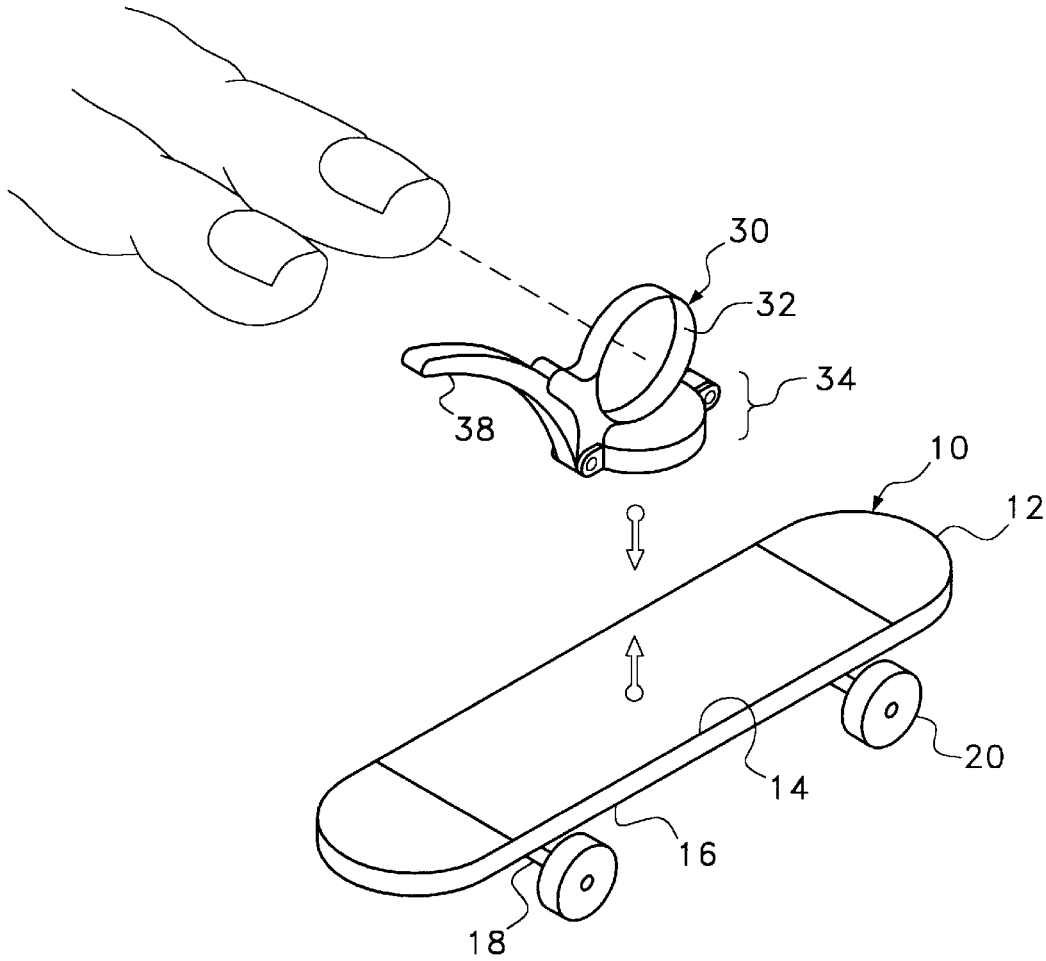
FIG. 1 is a perspective view of an exemplary embodiment of a finger board and external engagement mechanism in accordance with the present invention.

Referring to FIG. 1, there is shown an exemplary embodiment of a finger board 10 in accordance with the present invention. The finger board 10 has the overall appearance of a skateboard but is typically less than six inches long. The finger board 10 is comprised of a board 12 having a top surface 14 and a bottom surface 16. Suspension elements 18 extend from the bottom surface 16 of the board 12. The suspension elements 18 support the wheels 20 of the finger board 10 and the axles around which the wheels 20 rotate.

In prior art finger boards, some type of looped structures would extend upwardly from the top surface of the board. The looped structures would provide a mechanical means for attaching fingers or a figure to the top surface of the board. However, with the present invention, such looped structures are no longer necessary. With the present invention, either the entire board 12 is made of a ferro-magnetic material or a layer of ferro-magnetic material is disposed on the top surface 14 of the board 12. In the shown embodiment, a thin pieces of steel is laminated to the top surface 14 of the board 12.

Since either the top surface 14 of the board 12 or the entire board 12 is made from a ferro-magnetic material, at least the top surface 14 of the board 12 is attracted to a magnet. Accordingly, any magnet brought into contact with the top surface 14 of the board 12 is magnetically attracted to that surface.

When a person plays with a finger board, they engage the finger board with either their fingers or with a small poseable figure. In FIG. 1, a finger ring assembly 30 is shown. The finger ring assembly 30 is used as the interface through which a person can engage the finger board 12 with their finger tips. The finger ring assembly 30 contains a loop 32 through which one fingertip passes. As such, the finger ring assembly 30 physically attaches to one fingertip and moves with that fingertip.

Figure 2:
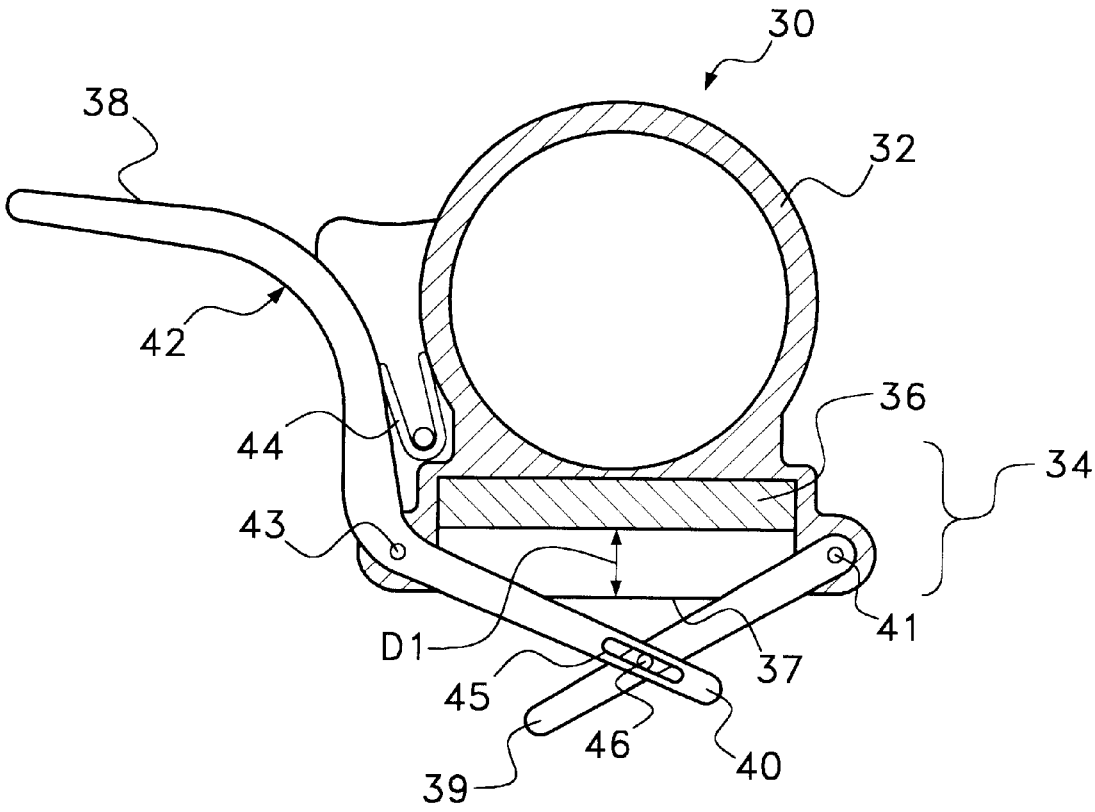
FIG. 2 is a cross-sectional view of the embodiment of the external engagement mechanism previously shown in FIG. 1.

Referring to FIG. 2, it can be seen that a base section 34 is located below the loop 32 of the finger ring assembly 30. Within the base section 34 is disposed a magnet that is strong enough to attract and retain the finger board 10. An activation lever 38 extends from the side of the finger ring assembly 30. When the activation lever 38 is pressed, the activation lever 38 causes the magnet within the base 34 of the finger ring assembly 30 to disengage from the finger board 10. As such, by placing a finger ring assembly 30 on a person's finger tip, a person can lift a finger board 10 by just touching the base section 34 of the finger ring assembly 30 to the top surface 14 of the finger board 10. To release the finger board 10 from the finger ring assembly 30, a person need only engage the activation lever 38 of the finger ring assembly 30 with the finger nearest that lever. Accordingly, with just a minimal amount of finger movement and coordination, a person can selectively lift and drop the finger board 10 as desired.

Referring to FIG. 2, it can be seen that within the base section 34 of the finger ring assembly 30 is disposed a magnet 36. The magnet 36 is positioned a predetermined distance Dl from the bottom edge 37 of the base section 34. Disposed between the magnet 36 and the bottom edge 37 of the base section 34 are two separator arms 39, 40. It is the separator arms 39, 40 that are used to separate the finger board 10 (FIG. 1) from the finger ring assembly 30. The first separator arm 39 is connected at a pivot 41 at one end of the base section 34 of the finger ring assembly 30. As such, the free end of the first separator arm is free to rotate about the pivot 41. The length of the first separator arm 39 is such that it can fit into the space between the magnet 36 and the bottom edge 37 of the base section 34.

The second separator arm 40 is the lower segment of a larger lever element 42. The lever element 42 incudes the activation lever 38 that protrudes to the side of the finger loop 32. The lever element 42 is connected to the base section 34 of the finger ring assembly 30 with a pivot 43. On one side of the pivot 43 is the second separator arm 40 and on the other side of the pivot 43 is the activation lever 38. The lever element 42 is biased in a retracted position by a spring 44. When biased in this retracted position, the second separator arm 40 is biased into the base section 34 of the ring assembly 30. Accordingly, when the activation lever 38 is pressed against the bias of the spring 44, the second separator arm 40 turns about the pivot 43 and its free end moves out of the base section 34 and away from the magnet 36.

The second separator arm 40 and the first separator arm 39 are interconnected through use of a slot 45 and post 46 or similar interconnection. As such, when the second separator arm 40 is caused to rotate away from the magnet 36 by the manual manipulation of the activation lever 38, the first separator arm 39 is also caused to rotate away from the magnet 36. Similarly, when the second separator arm 40 is caused to rotate toward the magnet 36 by the manual manipulation of the activation lever, the first separator arm 39 is also caused to rotate toward the magnet 36.

When the activation lever 38 is pressed against the bias of the spring 44, the first and second separator arms 39, 40 are caused to rotate out of the base region 34 away from the magnet 36. This causes the free ends of the first and second separator arms 39, 40 to extend beyond the bottom edge 37 of the base region 34 of the finger ring assembly 30. If a finger board 12 (FIG. 1) were biased against the bottom edge 37 of the base region 34 by the magnetic field of the magnet 36, the separator arms 39, 40 would move the finger board 10 (FIG. 1) away from the finger ring assembly 30 against the pull of the magnetic field. Eventually, the finger board 10 (FIG. 1) would move far enough away from the magnet 36 that the magnetic field of the magnet 36 is no longer strong enough to attract the finger board 10 (FIG. 1) against the pull of gravity. The finger board 12 (FIG. 1) would therefore be free to fall away from the finger ring assembly 30.

Figure 3:
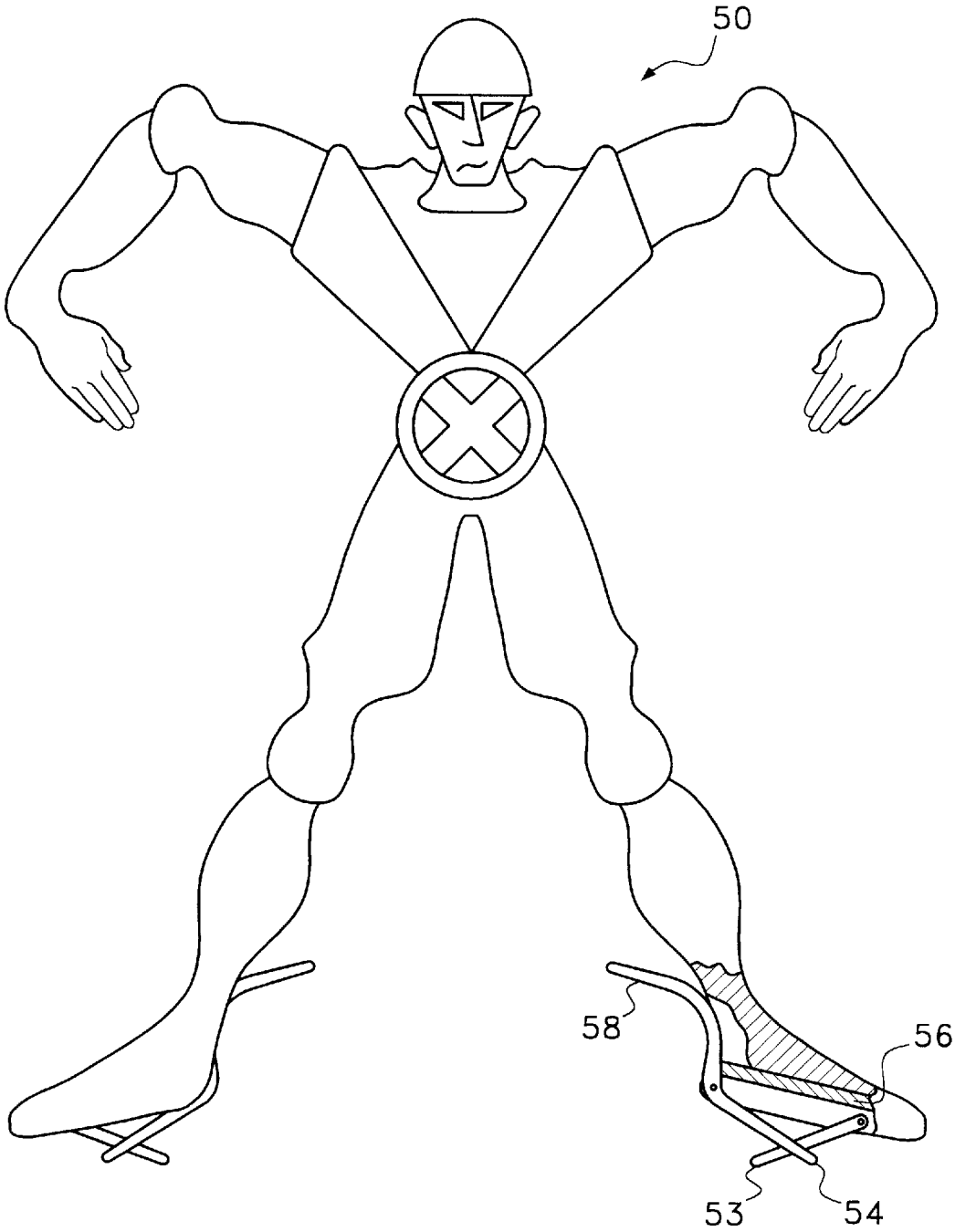
FIG. 3 is a selectively cross-sectioned front view of a poseable figure containing a finger board engagement mechanism.

Referring to FIG. 3, an exemplary embodiment of a poseable action figure 50 is shown. The action FIG. 50 is sized to be proportionate to the finger board 10 (FIG. 1) so as to be positionable on the finger board 10 (FIG. 1). The action figure 50 can be sold with the finger board or as an accessory to the finger board.

The action figure 50 is preferably a fully poseable figure with four limbs. If the action figure is a human, it will have two legs and two arms. When playing with a finger board, it is desirable to have a figure that will attach to the finger board so that the figure can ride the finger board. As has been previously described, the finger board has a top surface that is ferro-magnetic. No other attachment mechanisms are present on the finger board. As a result, in order to attach the figure to the finger board of FIG. 1, the figure has magnets disposed in its hands and feet. Consequently, when the hands or feet of the figure are brought into contact with the finger board, the hands and/or feet of the figure 50 magnetically attach to the finger board.

The figure may be constructed with magnets at the ends of its limbs. With such a figure, the finger board can be removed by manually pulling the finger board away from the figure against the bias of the magnet. To make the figure more interesting, magnet separation mechanisms 52 can be constructed into the limbs of the figure. In the shown embodiment, the magnet separation mechanisms are of the same construction as was previously described with regard to the finger ring assembly of FIG. 2.

The magnet separation mechanism 52 is comprised of two separator arms 53, 54 that are positioned in front of the magnet 56. One of the separator arms 54 is attached to an activation lever. When the activation lever 58 is depressed, the two separator arms 53, 54 rotate outwardly away from the magnet 56. If the finger board were attached to a limb of the figure 50, the movement of the separator arms 53, 54 would bias the finger board away from the magnet 56 until the force of gravity on the finger board surpasses that of the magnetic field and the finger board falls away.

In the embodiments previously described, the finger board has a top surface that contains steel or some other ferro-magnetic material. Such embodiments are merely exemplary. It should be understood that the top surface of the finger board itself can be magnetic. The entire board of the finger board can be magnetized or magnets can be embedded into the board of the finger board. If the top surface of the finger board itself is magnetic, the magnet(s) used should be so oriented so as to project a single pole magnetic field above the finger board. The magnets used in either the finger ring assembly (FIG. 2) or the limbs of the figure (FIG. 3) should project the opposite magnetic field toward the finger board. The opposite magnetic fields attract and create a strong magnetic bond between the finger board and the external magnet.

Furthermore, if the top surface of the finger board were magnetic, the finger board would attract to any ferro-magnetic surface. The finger board could therefore be used by a person wearing a metal ring or the like. Additionally, any figure having metal or magnetic properties at its feet or hands can be used in conjunction with the finger board.

It will be understood that the embodiments of the present invention described and illustrated herein are merely exemplary and a person skilled in the art can make many variations to the embodiments shown without departing from the scope of the present invention. For example, there are many mechanical spacer mechanisms that can project an extension when manually depressed. Any such mechanical spacer mechanism can be adapted for use in the present invention in place of the double separator arm mechanism specifically described. All such variations, modifications and alternate embodiments are intended to be included within the scope of the present invention as defined by the appended claims.

What is claimed is:

1. A magnetic device for lifting objects having ferromagnetic properties, said device comprising:

a finger ring supporting a housing;

a magnet supported by said housing, wherein said magnet has a front surface and projects an effective magnetic field a predetermined distance in front of said front surface;

a manually adjustable spacer supported by said housing in front of said front surface of said magnet, said spacer being selectively extendable in front of said magnet throughout a predetermined distance range, wherein said predetermined distance range includes distances both above and below said predetermined distance of the effective magnetic field.

2. The device according to claim 1, wherein said housing is part of a poseable figure.

3. The device according to claim 1 wherein said effective magnetic field is a magnetic field strong enough to attach said magnetic device to an object with enough force to lift the object.

4. The device according to claim 1, wherein said manually adjustable spacer is biased to a position below said predetermined distance.

5. The device according to claim 1, wherein said manually adjustable spacer includes a first arm coupled to said housing with a first pivot, said arm having a first end and a second end, wherein said first end of said first arm rotates away from said magnet when said second end is manually moved, thereby selectively moving said first end of said first arm through said predetermined distance range.

6. The device according to claim 5, wherein said manually adjustable spacer includes a second arm that is pivotably connected to said housing, wherein said second arm is coupled to said first arm and moves in unison with said first arm.

7. A device for selectively engaging a miniature skate board, comprising;

a magnet capable of attracting and lifting the miniature skateboard when the miniature skateboard is within a predetermined distance from said magnet;

a poseable figure containing a housing for supporting said magnet;

adjustable spacer, supported by said housing, for selectively limiting how close the miniature skateboard can be brought to said magnet, said adjustable spacer being adjustable between a first distance that is smaller than said predetermined distance and a second distance that is larger than said predetermined distance.

8. The device according to claim 7, wherein said housing is part of a finger ring.

9. The device according to claim 7, wherein said manually adjustable spacer includes a first arm coupled to said housing with a first pivot, said arm having a first end and a second end, wherein said first end of said arm rotates away from said magnet when said second end is manually moved, thereby selectively moving said first end of said first arm between said first distance and said second distance.

10. The device according to claim 9, wherein said manually adjustable spacer includes a second arm that is pivotably connected to said housing, wherein said second arm is coupled to said first arm and moves in unison with said first arm.

11. A method of engaging a miniature skateboard with a person's hand, comprising the steps of:

providing a ring having a magnet and a manually adjustable spacer in front of the magnet;

bringing said ring close to the miniature skateboard so that the magnet attracts the miniature skateboard and retains the miniature skateboard in contact with the ring:

selectively adjusting the spacer to extend the distance between the magnet and the miniature skateboard, thereby causing the magnet to release the miniature skate board.

12. The method according to claim 11, wherein said step of selectively adjusting the spacer includes wearing the ring on a first finger and engaging an adjustment lever on the side of the ring with an adjacent finger.

* * * * *